US008640920B2

(12) United States Patent
Sharp et al.

(10) Patent No.: US 8,640,920 B2
(45) Date of Patent: Feb. 4, 2014

(54) METHOD OF FORMING AND FILLING A POUCH

(75) Inventors: Phillip Neal Sharp, Sunnyvale, CA (US); Sven Newman, Burlingame, CA (US); David C. Thomsen, San Mateo, CA (US); Anita G. Mooy, Charlotte, NC (US)

(73) Assignee: Momentive Performance Materials Inc., Waterford, NY (US)

( * ) Notice: Subject to any disclaimer, the term of this patent is extended or adjusted under 35 U.S.C. 154(b) by 339 days.

(21) Appl. No.: 12/577,653

(22) Filed: Oct. 12, 2009

(65) Prior Publication Data

US 2010/0115891 A1 May 13, 2010

Related U.S. Application Data

(63) Continuation-in-part of application No. 11/613,661, filed on Dec. 20, 2006, and a continuation-in-part of application No. 12/200,376, filed on Aug. 28, 2008, now Pat. No. 8,544,687, and a continuation-in-part of application No. 12/236,555, filed on Sep. 24, 2008.

(51) Int. Cl.
*B65D 35/00* (2006.01)

(52) U.S. Cl.
USPC ..... 222/107; 53/459; 222/103

(58) Field of Classification Search
USPC ..... 222/107, 95, 541.1, 541.9, 103, 92, 222/105; 53/459, 128.1, 410; 141/2, 10
See application file for complete search history.

(56) References Cited

U.S. PATENT DOCUMENTS

| | | | | | |
|---|---|---|---|---|---|
| 2,390,822 | A | | 12/1945 | Wren | 222/572 |
| 2,723,779 | A | | 11/1955 | Parker et al. | 222/104 |
| 2,779,462 | A | * | 1/1957 | Hoag | 206/45.24 |
| 2,878,967 | A | | 3/1959 | Duke | 222/107 |
| 2,903,161 | A | * | 9/1959 | Stahmer | 222/81 |
| 3,354,924 | A | | 11/1967 | Birrell et al. | 220/666 |
| 3,418,059 | A | * | 12/1968 | Robe | 401/266 |
| 3,635,376 | A | | 1/1972 | Hellstrom | 222/107 |
| 3,768,699 | A | * | 10/1973 | Robe, Jr. | 222/103 |

(Continued)

FOREIGN PATENT DOCUMENTS

| | | |
|---|---|---|
| JP | 2001-018989 | 1/2001 |
| WO | WO92/09494 | 6/1992 |

OTHER PUBLICATIONS

English translation of JP 2001 018989.*

(Continued)

*Primary Examiner* — Kevin P Shaver
*Assistant Examiner* — Robert Nichols, II
(74) *Attorney, Agent, or Firm* — Philip D. Freedman; Philip D. Freeman PC; Joseph E. Waters

(57) ABSTRACT

A method of forming and filling a pouch, comprises forming opposing walls of a film; sealing the opposing walls of film together to form at least one pouch; filling an interior section of the at least one pouch through an opening in an upper portion of the at least one pouch with a flowable material; forming a top sealed expressing-shaped region to close the opening in the at least one pouch; and cradling the pouch with a foldable flat that is more rigid than the pouch that can be folded or rolled to compress the pouch to express the flowable material through the expressing shaped region.

23 Claims, 5 Drawing Sheets

(56) References Cited

U.S. PATENT DOCUMENTS

| | | | | | |
|---|---|---|---|---|---|
| 3,913,734 | A | * | 10/1975 | Siegel | 206/470 |
| 3,950,918 | A | * | 4/1976 | Morrow et al. | 53/410 |
| 3,986,640 | A | | 10/1976 | Redmond | |
| 4,148,417 | A | | 4/1979 | Simmons | |
| 4,236,652 | A | * | 12/1980 | Beguhn | 222/92 |
| 4,671,026 | A | | 6/1987 | Wissinger | |
| 4,817,344 | A | | 4/1989 | Wissinger | |
| 4,863,014 | A | | 9/1989 | Summons | |
| 4,974,732 | A | | 12/1990 | Sullivan | |
| 4,979,656 | A | * | 12/1990 | Looker | 222/541.2 |
| 5,034,455 | A | | 7/1991 | Stein | |
| 5,180,063 | A | | 1/1993 | Sakno | |
| 5,228,782 | A | | 7/1993 | Imer | |
| 5,368,199 | A | * | 11/1994 | Haas et al. | 222/146.5 |
| 5,373,965 | A | | 12/1994 | Halm et al. | 222/92 |
| 5,654,082 | A | | 8/1997 | Kagawa | |
| 5,960,993 | A | * | 10/1999 | Mitsui et al. | 222/92 |
| 6,003,730 | A | * | 12/1999 | David et al. | 222/107 |
| 6,090,451 | A | | 7/2000 | Barth | |
| 6,119,928 | A | * | 9/2000 | Lasson et al. | 229/5.82 |
| 6,207,242 | B1 | * | 3/2001 | Hoffman | 428/34.2 |
| 6,241,287 | B1 | | 6/2001 | Best | |
| 6,269,654 | B1 | | 8/2001 | Murray | |
| 6,305,132 | B1 | | 10/2001 | Smith | |
| 6,305,577 | B1 | | 10/2001 | Fillmore | |
| 6,451,440 | B2 | | 9/2002 | Atwood | |
| 6,557,731 | B1 | | 5/2003 | Lyon et al. | 222/94 |
| 6,659,278 | B1 | | 12/2003 | Velliquette | |
| 6,662,948 | B1 | | 12/2003 | Vellliquette | |
| 6,755,357 | B2 | * | 6/2004 | Duqueroie et al. | 239/327 |
| 7,241,066 | B1 | | 7/2007 | Rosen et al. | 401/183 |
| 2001/0038020 | A1 | | 11/2001 | Schalow | |
| 2001/0048198 | A1 | | 12/2001 | Dulin | |
| 2001/0049427 | A1 | | 12/2001 | Atwood | |
| 2003/0089625 | A1 | | 5/2003 | Moodie | |
| 2003/0192909 | A1 | * | 10/2003 | Maskell | 222/103 |
| 2004/0226968 | A1 | | 11/2004 | LaFond | |
| 2004/0238565 | A1 | * | 12/2004 | Turano | 222/103 |
| 2005/0152624 | A1 | | 7/2005 | Versluys | |
| 2005/0217034 | A1 | | 10/2005 | Miller | |
| 2006/0226171 | A1 | | 10/2006 | Sternberg | |
| 2007/0266901 | A1 | | 11/2007 | Rance et al. | 106/501.1 |
| 2007/0272705 | A1 | | 11/2007 | Beine et al. | 222/107 |
| 2008/0197042 | A1 | | 8/2008 | Ullrich | |
| 2008/0275418 | A1 | * | 11/2008 | Hughes et al. | 604/385.18 |
| 2009/0110856 | A1 | | 4/2009 | Gummaraju et al. | 428/35.7 |
| 2010/0163581 | A1 | * | 7/2010 | Vandromme | 222/214 |

OTHER PUBLICATIONS

ISR PCT 09/60541, Sep. 12, 2009, Monentive Performance Materials Inc.

* cited by examiner

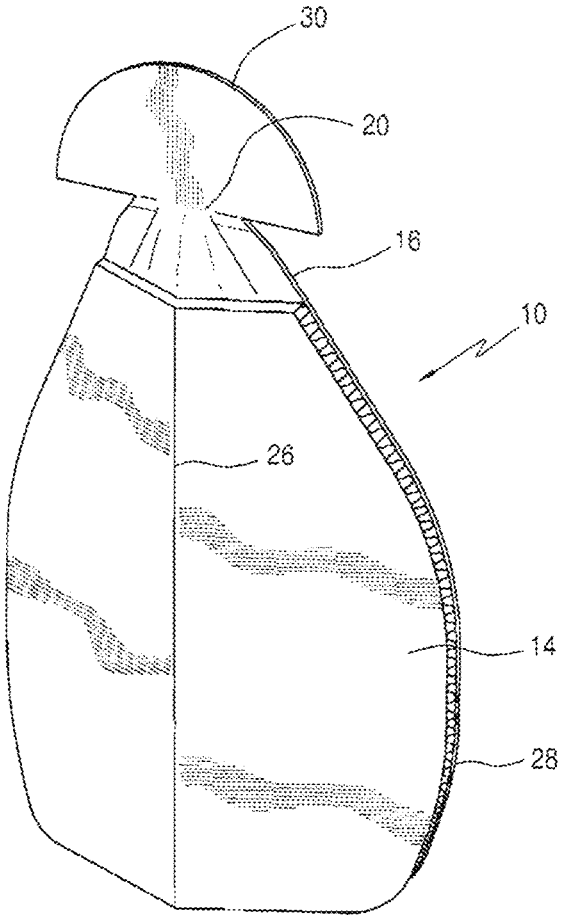
FIG. 4
FIG. 5
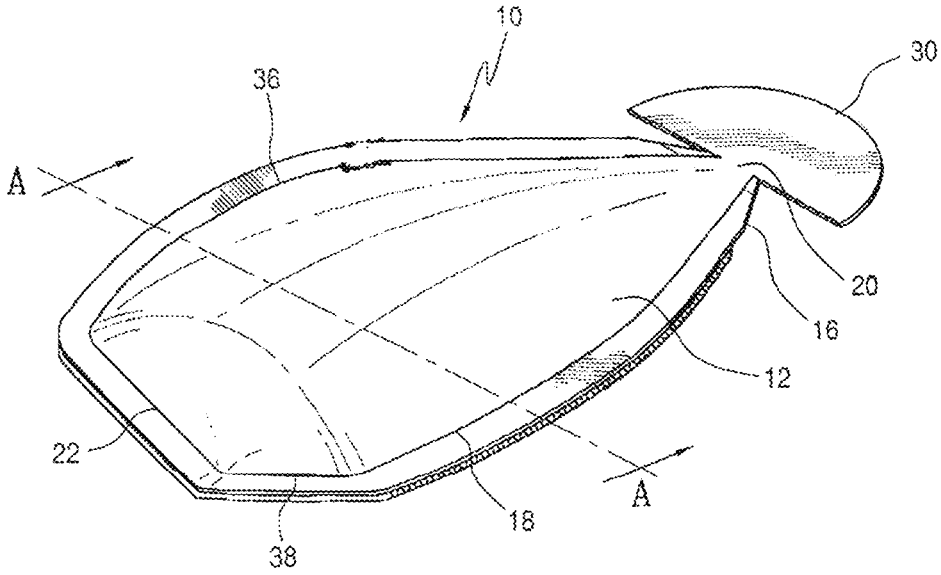

METHOD OF FORMING AND FILLING A POUCH

This application is a continuation-in-part of U.S. application Ser. No. 11/613,661, filed Dec. 20, 2006, which is incorporated herein by reference in its entirety and this application is a continuation-in-part of U.S. application Ser. No. 12/200,376, filed Aug. 28, 2008 now U.S. Pat. No. 8,544,687 which claims benefit of provisional application 60/969,232 filed Aug. 31, 2007, which are incorporated herein by reference in their entirety and this application is a continuation-in-part of U.S. application Ser. No. 12/236,555, filed Sep. 24, 2008.

BACKGROUND OF THE INVENTION

The invention relates to a method of forming a pouch for dispensing viscous material.

Viscous materials can include sealant, mastic, adhesive, glazing, caulk, grout and glue compositions. Typically, such viscous materials are packaged, stored or commercialized in cardboard containers or plastic dispensers or cartridges that are adapted to be loaded into an extrusion device such as a caulking gun. These viscous materials include silicone sealants and caulks that are used in building and construction applications. Some of these compositions are referred to as room temperature vulcanizable (RTV) compositions. They may include a moisture-curable polyorganosiloxane polymer, filler, and a condensation cure catalyst. When used as sealants, these compositions can be packaged in a moisture impervious tube and applied to a substrate by extrusion from the packaging tube.

There are difficulties associated with these containers. For example, some materials are merchandised in cartridges for loading into a caulk dispenser or gun. The dispenser or gun is another item that must be purchased, stored, cleaned and maintained as part of the caulking process. The dispenser or gun may be cumbersome and difficult to operate, especially in constrained spaces in buildings under construction. Also, the dispensing device may require significant hand strength, which adds challenge to dispensing and laying a clean sealant bead.

In one process, a quantity of sealant is expressed from a dispensing tube or cartridge directly to a crevice to seal the area when dried. Typically, the dispensing tube or cartridge will contain more material than an amount required for a particular sealing job. Usually some unused portion of the tube remains after a required amount has been dispensed. The dispensing tube with the unused portion is discarded or is saved for futures use. Discarding is uneconomical and may be highly undesirable for environmental reasons. At present, there is no known recycling available for the wide variety of sealant compositions available on the market.

If the container with residual sealant is not discarded, it will need to be capped to save the material without setting for future use. But, the sealant may include a volatile component that will evaporation to harden residual material. Other sealants may be settable from exposure to atmosphere oxygen. And unless the container is correctly reclosed, the residual material will be lost.

Some dispensing containers are merchandised with a nozzle-engaging, snap-fit bead and groove or screw thread to provide a secure fit to the container body. But these caps are fragile pieces that are easily split or otherwise damaged from over-tightening. Or, the snap-fit bead and groove may not provide an enduring reclose fit until the time when the tube is next required for a caulk job. Some informal capping devices have included the placing of a nail into the tube opening, to effect a plug type reclosure. Or, the container cap may be merchandised with a plug member to provide this function. But frequently, these solutions do not prevent content hardening for more than a short period of time.

Other reclosing approaches have included wrapping the container tip with aluminum foil or plastic wrap, secured with a rubber band and enclosing the entire container in a sealable plastic packet. But, oftentimes these mechanisms do not work because the packets rupture or the packets contain enough air to dry the tube contents. And, a foil or wrap can not be closely and tightly wrapped around the tube and nozzle without air gap.

There is a need for a viscous material container such as a pouch that overcomes the problems of waste and difficulty of use of current dispensers. And. there is a need for a method to form such a pouch.

BRIEF DESCRIPTION OF THE INVENTION

The invention provides a method to form a viscous material dispenser that can be used to make a pouch that overcomes current problems of waste, cost and difficulty of use. In an embodiment, the method of forming and filling a pouch, comprises forming opposing walls of a film; sealing the opposing walls of film together to form at least one pouch; filling an interior section of the at least one pouch through an opening in an upper portion of the at least one pouch with a flowable material; forming a top sealed expressing-shaped region to close the opening in the at least one pouch; and cradling the pouch with a foldable flat that is more rigid than the pouch that can be folded or rolled to compress the pouch to express the flowable material through the expressing shaped region.

BRIEF DESCRIPTION OF THE DRAWING

FIGS. 4 and 5 are schematic perspective views of a packet, front and back;

DETAILED DESCRIPTION OF THE INVENTION

The term sealant as used herein includes an entire variety of caulks including silicones, latex and acrylic caulk; filler compounds; adhesive or mastic-type materials, such as stucco, concrete and cementious-material patching and crack filling compounds; gasketing compounds; gutter, flashing, skylight, or fish tank seam or sealant compounds; butyl or rubber sealants, cements and caulk; roof cements; panel and construction adhesives; glazing compounds and caulks; gutter and lap sealants; silica gel-based firebrick, masonry and ceramic crack fillers and cements; silicone-based glues; ethylene glycol-containing latex glazing compounds; and the like.

One preferred sealant is an organopolysiloxane room temperature vulcanizable (RTV) composition. The room temperature vulcanizable silicone elastomer composition can contain a silanol stopped base polymer or elastomer, reinforcing and/or extending filler, cross-linking silane and cure catalyst. These RTV compositions are prepared by mixing diorganopolysiloxanes having reactive end groups with organosilicon compounds that possess at least three hydrolyzably reactive moieties per molecule. The known RTV compositions are widely used as elastic sealing materials for applications involving the gaps between various joints such as the gaps between the joints of building materials, the joints between structural bodies and building materials in buildings, between the bathtub and wall or floor, cracks on tiles in bathrooms, gaps in the bathroom such as those around the washbasin and those between the washbasin supporting board and the wall, gaps around the kitchen sink and the vicinity, between panels in automobiles, railroad vehicles, airplanes, ships, gaps between prefabricated panels in various electric appliances, machines, and the like. Room temperature vulcanizable silicone sealants thus may be utilized in a wide variety of caulking and sealing applications.

Features of the invention will become apparent from the drawings and following detailed discussion, which by way of example without limitation describe preferred embodiments of the invention.

Figure 1:
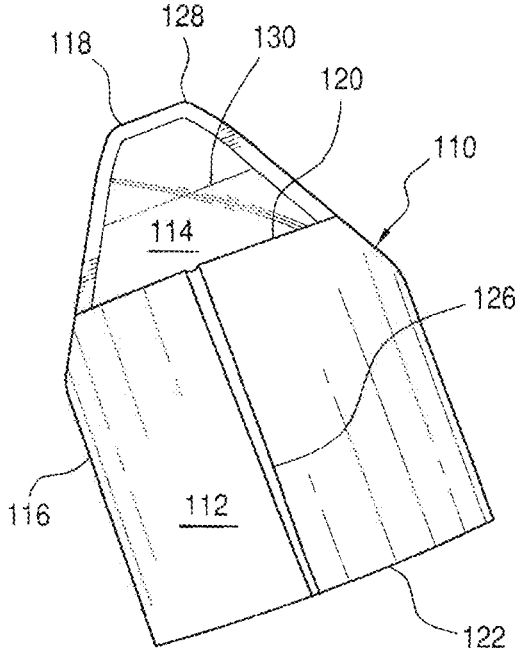
FIG. 1 is a front elevation view of a packet.
Figure 2:
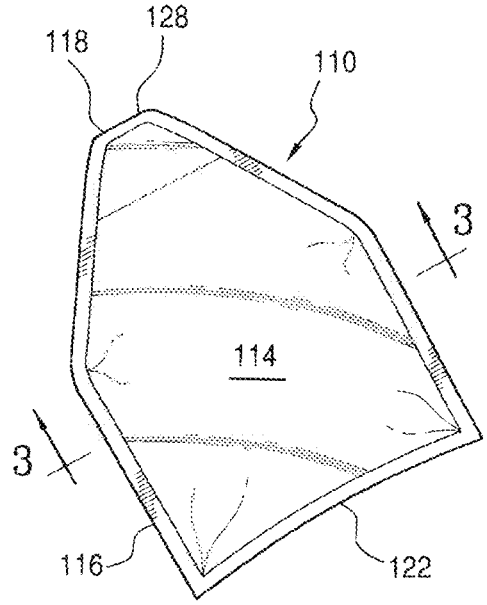
FIG. 2 is a rear elevation view.
Figure 3:
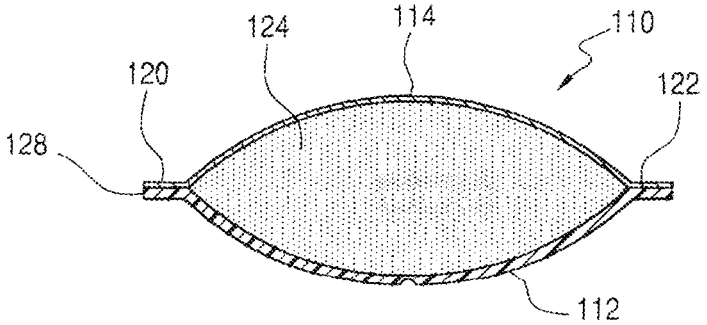
FIG. 3 is a cut away view of the packet through 3-3 of FIG. 2.

FIG. 1, FIG. 2 and FIG. 3 illustrate an embodiment of the invention. FIG. 1 is front elevation of viscous material dispenser according to the invention. The dispenser is in the form of a packet 110. FIG. 2 is an elevation of the packet 110 from a back side. The packet 110 comprises two thin sidewalls of plastic or foil film, a top film 112 and a bottom film 114. The films 112, 114 can be heat-sealed or otherwise connected together along edge 116 to form a pouch 118 as shown in FIG. 3 with a first closure end 120 and a second closure end 122 that form an expressing shape tip 128. Or, the top film 112 and bottom film 114 can be from a single film that is folded into the pouch 118 shape. The film material can be impermeable or only slightly permeable to water vapor and oxygen to ensure product vitality. Preferably the material has a permeability rating of 1 or lower. Suitable film materials include a plastic film, such as low-density polyethylene or other thermoplastic or foil film material. The top film 112 of packet 110 includes a crease 126 running longitudinally to the packet 110 from second closure end 122 toward the first closure end 120. The crease 126 facilitates longitudinal folding of the packet 110, as hereinafter described. The crease 126 can be a pressed, folded, wrinkled line or score.

FIG. 3 is a cut away side view of the packet 110 showing pouch 118 containing a sealant 124. The top film 112 can be pleated (not shown) to allow for an increased volume of sealant 124. The packet 110 is creased 126 in the middle to allow for folding as hereinafter described. Nozzle 128 is formed from the tapering ends of top film 112 and bottom film 114. The nozzle 28 can be a heat seal closure that can be opened by tearing or cutting with scissors or a knife or simply from pressure of sealant 124 expanding into and then from the nozzle 128. Or in an embodiment, the nozzle 128 can be closed by serrated embossing to provide for easy tear opening.

A portion 130 of the dispenser toward the first closure end 120 can comprise a more rigid or thicker material to impart added structure and strength. For example, the portion 130 can comprise a multiple laminated film that is the same as film as the rest of the dispenser. Or, the portion 130 can comprise a different film that is more dense than the film of the rest of the dispenser.

Figure 6:
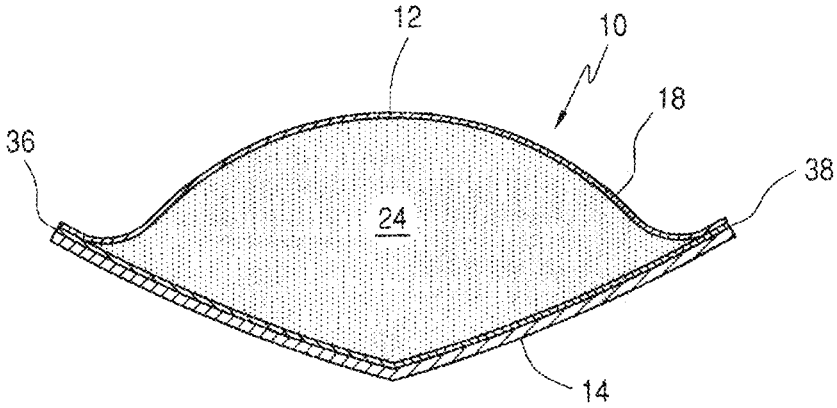
FIG. 6 is a cut-away view through A-A of the FIG. 2 packet.

FIG. 4, FIG. 5 and FIG. 6 illustrate an embodiment of the invention. FIGS. 4 and 5 are schematic perspective views of a packet, front and back and FIG. 6 is a cut-away view through A-A of the FIGS. 4 and 5 packet. FIG. 4 is a front view of the packet 10. FIG. 5 is a perspective of the packet 10 from a back side. FIG. 3 is a cut away side view of the packet 10. The size of packet 10 can vary, but in some embodiments can be about 20 cm by 15 cm or smaller.

The packet 10 comprises a pouch 12 of plastic or foil film, a rigid flat 14 comprising a more rigid or thicker material than the pouch 12 film and a spout-forming area 16 on the rigid flat 14 side of the packet 10. The area 16 comprises a shaped material of intermediate thickness and rigidity between that of the material of the pouch 12 and the material of the flat 14. In the embodiment shown in the figures, area 16 is trapezoidal-shaped with slanted sides from the rigid material sidewall 14 toward the packet tip end 20 that forms a tapered nozzle when folded or rolled with the rigid flat 14.

Figure 8:
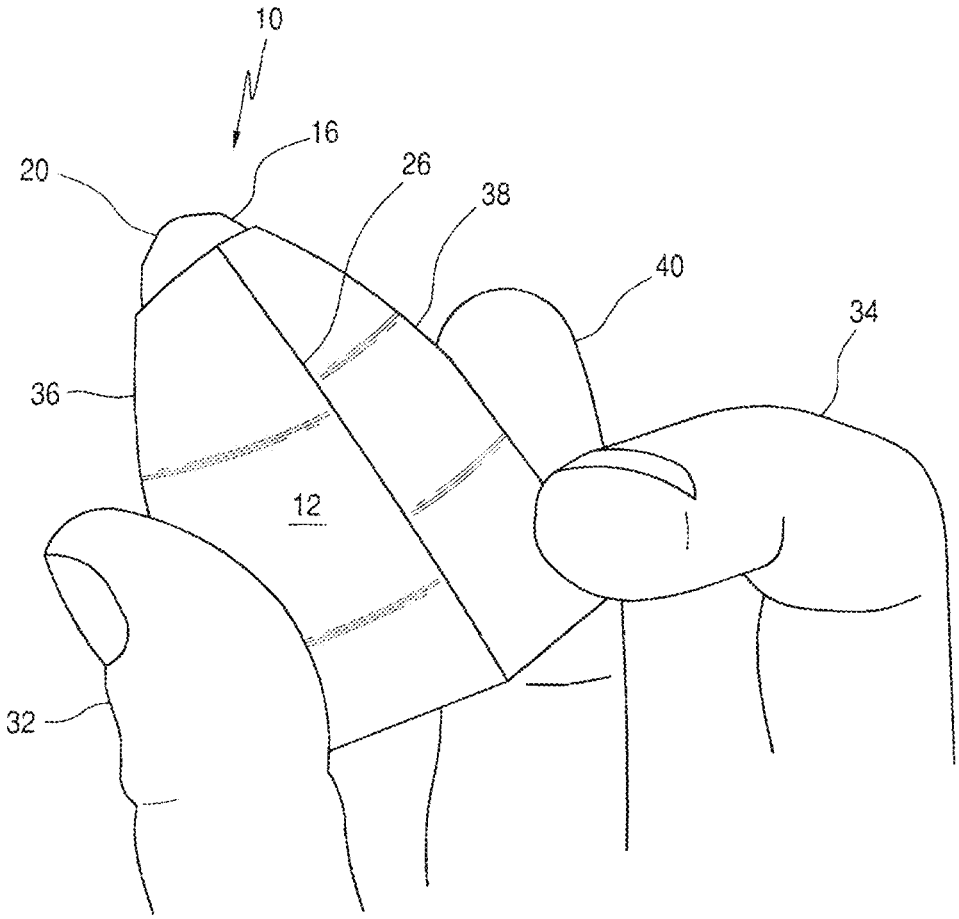
FIGS. 7, 8, 9, 10, 11 and 12 are schematic perspective views of use of the packet.

The pouch 12 can be heat-sealed or otherwise cradled to the flat 14 as shown in FIG. 6. A first closure end of pouch 12 firms an expressing shape tip 20. In FIGS. 4, 6 and 8, the more rigid flat 14 has crease 26 that can be a fold or score running along the longitudinal axis of the more rigid flat 14 from tip 20 to a second closure end 22. The crease 26 is marked into the flat 14 surface to facilitate longitudinal folding of the packet 10, as hereinafter described. The crease 26 can be a pressed, folded, wrinkled, embossed line or score. The crease 26 can run generally longitudinal to a long axis of the packet 10 from one end of the packet 10 toward the tip end 20.

The packet 10 further includes a semicircular-shaped tear tab 30 to facilitate opening at the tip 20. The top film 12 can be pleated 28 to allow for an increased volume of a sealant 24.

The crease 26 promotes longitudinal folding of opposite rigid flat sections against the pouch 12 to compress the pouch 12 to express sealant 24 from the pouch 12 interior. The more rigid flat 14 comprises a rigid or conformable surface that is configured to form cradling compression surfaces against pouch 12 when folded by a force applied to rigid flat 14 opposite sections as hereinafter described. The more rigid flat 14 can be a flat comprising any material that is more inflexible or rigid than the pouch 12 material. An area 16 on the rigid flat 14 side of the packet 10 comprises a shaped strip of intermediate thickness and rigidity between the material of the pouch 12 and the material of the flat 14.

Materials suitable for pouch 12 include single layer, coextruded or laminated film or foil. Preferably the material has a permeability rating of 1 or lower. Suitable film materials include a plastic film, such as low-density polyethylene or other thermoplastic or foil film material such as polypropylene, polystyrene or poly-ethylene-terephtalate. The foil is a thin, flexible leaf or sheet of metal such as aluminum foil for example. In one embodiment, the film is a polyethylene and bioriented polypropylene coextruded film. An aluminum foil is a preferred pouch 12 film material. Suitable foil can be derived from aluminum prepared in thin sheets with a thickness less than 0.2 mm/0.008 in, although much thinner gauges down to 0.006 mm can be used. A suitable foil can comprise a laminate with other materials such as a plastic or paper.

The pouch 12 material can be impermeable or only slightly permeable to water vapor and oxygen to assure content viability. For example, the film can have a moisture vapor transport rate (MVTR, ASTM D3833) of less than 10 g/day/$m^2$. In an embodiment, the MVTR of the film is less than 5 g/day/$m^2$ and preferably less than 1 g/day/$m^2$ and most preferably of less than 0.5 g/day/$m^2$. The pouch 12 film can be of various thicknesses. The film thickness can be between I0 and 150 μm, preferably between 15 and 120 μm, more preferably between 20 and 100 μm, even more preferably between 25 and 80 μm and most preferably between 30 and 40 μm.

The more rigid flat 14 comprises a substantially rigid substrate with a fold-imparting crease 26 or a substantially conformal substrate that can be rolled or folded against the pouch 12. The rolling or folding compresses the pouch 12 to cause sealant 24 to be expressed from pouch 12 interior through a nozzle formed at the tip end 20. The material of the more rigid flat 14 is substantially inflexible and less compliant than the material of top film 12. In this application, the term "rigid" means having the physical property of being stiff and resistant to bending. In an embodiment, the bottom material 14 is more rigid as measured in accordance with a Taber Stiffness method such as the ASTM D1044 Taber test.

The flat 14 can comprise any suitable rigid or semi-rigid material such as cardboard, paperboard, corrugated board and any wood-based type of paper or rigid or semi-rigid plastic sheet material. Cardstock is a suitable more rigid material. Cardstock thickness is often described by pound weight. Pound weight is the weight of 500, 20" by 26" sheets. In the US, cardstock thickness is usually measured in points or mils that gives the thickness of the sheet in thousandths of an inch. For example, a 10 pt. more rigid flat is 0.010 inches thick; 12 pt. is 0.012 inches.

The flat 14 can comprise a combination of paperboards, usually two flat pieces of paper and one inner fluted corrugated medium. Further suitable more rigid flat materials include stiff paper, cardboard, pasteboard or paperboard including corrugated paperboard and polyethylene such as 0.0015 inch high density polyethylene. The more rigid flat 14 can comprise a substantially rigid material such as a thermoplastic, for example ABS (acrylonitrile-butadiene-styrene). One preferred flat 14 material is a paperboard that is 10 mils or 0.010 inches in thickness or greater.

Corrugated fiberboard is a preferred material for flat 14. Corrugated fiberboard has two main components: a linerboard and a medium. Both can be made of a heavy paper called containerboard. Linerboard is a flat facing that adheres to the medium. The medium is typically an inner fluted corrugated material. The corrugated board can be one medium glued to one flat sheet of linerboard, a medium between two sheets of linerboard and even three sheets of linerboard with two mediums between. The fluted medium forms rigid arched columns that can resist bending and pressure from all directions. It has been found that a corrugated board serves especially well as a flat to cradle a sealant-filled pouch to aid in expressing sealant as hereinafter described with reference to FIGS. 5 through 9.

In embodiments, the pouch 12 comprises a multilayer polymer laminate along with an aluminum layer having a thickness between about 0.0045 and about 0.0065, preferably about 0.0055 inches. The area 16 comprises high density polyethylene (HDPE) having a thickness between about 0.012 and 0.018 inches, preferably about 0.015 inches. The rigid material 14 comprises corrugated fiberboard having a thickness between about 0.045 and 0.060, preferably between 0.050 and 0.055 inches. The suitable pouch 12, flat 14 and area 16 materials can be subject to the proviso that the rigidity of the flat 14 material is greater than that of the pouch 12 material and the rigidity of area 16 material is intermediate between that of the pouch 12 and that of the flat 14 materials.

Figure 7:
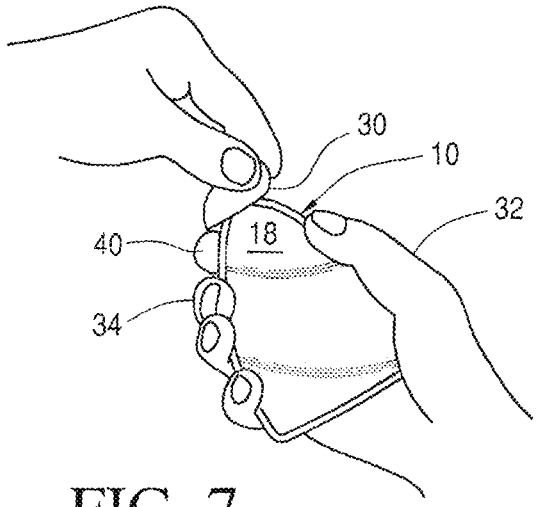
Figure 9:
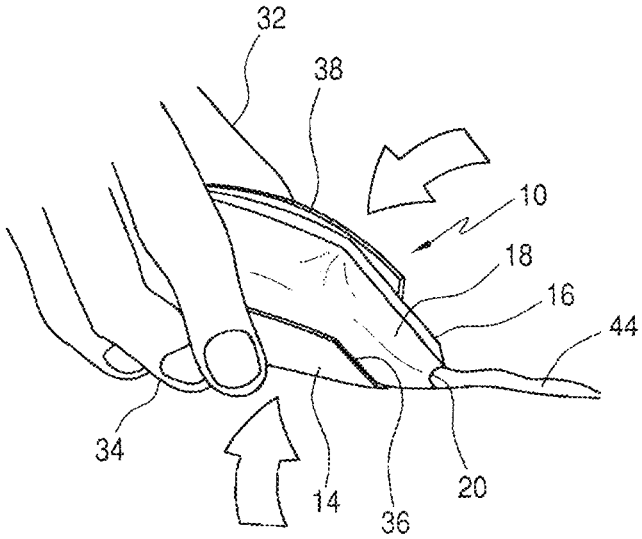

FIGS. 4, 5, 6, 7, 8 and 9 are schematic perspective views illustrating a use of the packet 10. In FIG. 7, the packet 10 is held in one hand while opened with the other hand by tearing away tab 30 as illustrated. In applying a viscous material such as a caulk, the packet 10 can be grasped by hand with pouch 12 side up as shown in FIG. 8. Thumb 32 and second finger 34 are located on opposing edges 36, 38 of the more rigid flat 14. Index finger 40 is impressed against pouch 12 toward crease 26 to commence folding of more rigid flat 14. With the force applied by thumb 32 and second finger 34 to opposing edges 36, 38, the packet 10 begins to fold along crease 26. Folding can be facilitated by a user imposing the length of index finger 40 against the pouch 12 while the side force is applied by thumb 32 and second finger 34 as shown in FIG. 8. In this example, more rigid flat 14 comprises a substantially rigid material with planar face underlying the pouch 12 that cradles the pouch 12 as more rigid flat 14 is folded along crease 26 as shown in FIG. 9.

Figure 10:
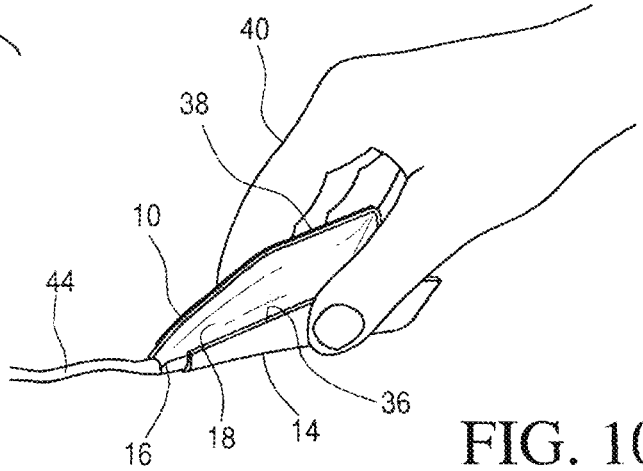
Figure 11:
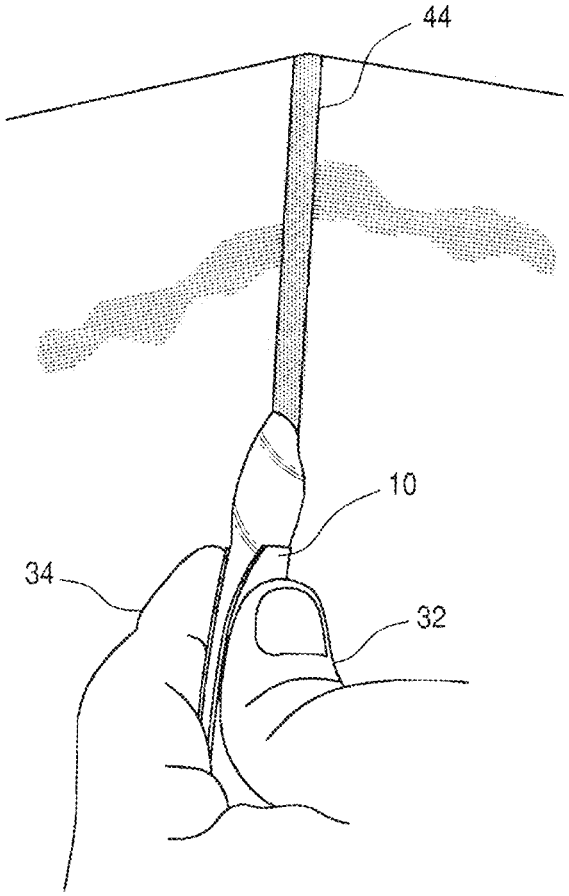
Figure 12:
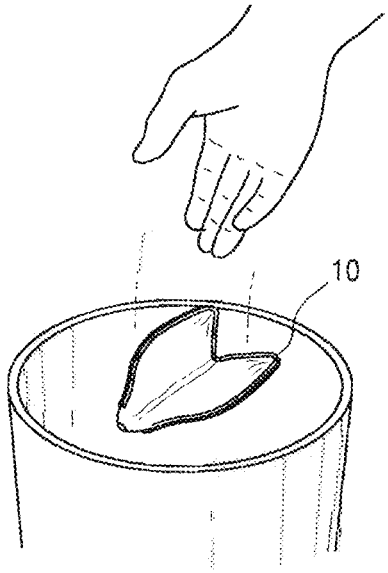

As shown in FIGS. 9 and 10, the folding drives enclosed sealant 24 from within pouch 12 up through tip-shaped first closure end 20 as shown in FIG. 9. Initially, the sealant 24 can be contained within the pouch 12 of the packet 10 and the shaped area 16 will be flat and devoid of sealant 24. But, as the packet 10 is folded and pressed as shown in FIG. 9, the sealant is forced into area 16. The area 16 swells and forms an expressing tip shape. The substantially rigid structure formed from the over-folding of two sides of the packet 10 can be firmly held and guided to express a controlled sealant bead 44 from area 16 as shown in FIGS. 10 and 11. The area 16 is shaped to allow sealant to fill the rest of the tip and flow from the tip. The area 16 can be shaped to an appropriate bead size, for example, $\frac{1}{8}^{th}$ inch in diameter. A user can further regulate bead size by applied pressure and speed as illustrated in FIGS. 10 and 11. Once the sealant 24 has been applied and the pouch 12 voided of material, the empty packet 10 can be discarded as illustrated in FIG. 12

The following Examples are illustrative and should not be construed as a limitation on the scope of the claims.

Example 1

Packet samples are evaluated to establish a design for dispensing a viscous material.

The samples are constructed from clear polypropylene Ziploc® packets, thin (<1 mm) black polypropylene and polyethylene sheet and acrylic thin film (<1 mm). The sheet materials are formed and heat sealed into packet shapes by first cutting oversized top and bottom rectangular shapes with triangular ends and heat sealing the pieces together with the triangular ends at one side to form a nozzle. Some of the packets are formed with gussets. The gussets are formed by folding the film at the packet sides and bottom.

Excess material is cut away from the packet after forming. Each packet is filled with material and then heat sealed to form an enclosure. The packets vary in length from about 4 cm to 20 cm, in width from about 2 cm to 15 cm and in thickness (filled with material) from about 0.5 cm to 2 cm. The packets are filled with acrylic caulk or silicone sealant.

A panel of evaluators is assembled to evaluate each packet from an array of 20 to 30. The packets are evaluated for content integrity and ease and control of material expression. In the evaluation, the panel visually and tactilely inspects each packet before dispensing material. Then members of the panel fold each packet to express its contents. The panel notes ease of control of expression of the material bead onto a test cardboard. Also, the panel observes any failure in packet integrity.

The packets are evaluated for dispersing both acrylic caulk and silicone sealant. The panel practices multiple dispensing for each configured packet. The panel then approves a selection of packets for next step evaluation. The process is reiterated with successive packets constructed according to characteristics of successful packets from a round of a previous evaluation.

The panel identifies packet designs that do not fully fill with material, do not form a round orifice for expressing a uniform bead and are insufficiently flexible to fully fill. Some expressing faults are addressed by changing nozzle angle and length in packets for subsequent evaluation rounds. Some first round designs are observed as too flimsy to allow for fine control needed to dispense a continuous smooth bead of material. This is addressed by (1) making one of the surfaces of the packet out of a more rigid plastic sheet, and (2) modifying user interaction to fold the packet along the crease length to provide an even more rigid dispensing structure.

Some designs are noted as having too thin a film. With these packets, the material resists sliding inside the packet thus making it difficult to completely express packet contents. This problem is addressed with a gusset designed packet to increase the volume of the packet while maintaining or decreasing the packet internal surface area.

A creased semi-rigid plastic backing for the packet is determined as a best design to hold a desired quantity of material and to ease folding for dispensing. The packet is sized overall (7 cm×5 cm×1.5 cm) to be manipulated to completely express material with one hand. The selected dispenser nozzle has a longer, 2 cm and narrower, 1 cm nozzle to allow the packet to be squeezed without nozzle deformation. And. the selected packet design has gussets on the sides to increase volume while minimizing internal surface area, so that material can be dispensed by one hand finger compression.

Example 2

A resulting design was functionally tested by others that represented a consumer panel. Ten packets of the design were distributed among 6 persons of the panel. Each person was instructed to express material from a packet according to a procedure of manually pressing the packet with one hand with an index finger along the crease to fold the packet longitudinally to express the sealant from the packet nozzle.

A jury of designers observed the expressing procedures and noted the panel's comments. The consumer panel responses were filmed to capture use of the packet and comments The panel approved the proposed design. The following panel comments on the design were recorded: "This is really nice! I'm digging this." "I think that's kind of amazing. I can only say good things about it." "Super easy to use. I love the bead that it gave me. It feels like I have a lot of control." "I like this already, and I'll tell you why. Because you can really manipulate the pressure. You can do a lot, or you can do a little." "You've addressed the issue of most people at home not needing a huge quantity [of caulk]." "Once you get used to using these, as you can see already on my first run, you're pretty much a professional."

This EXAMPLE illustrates a prospective commercial success for a viscous dispenser according to the invention.

Example 3

This EXAMPLE describes a series of iterative evaluations of packet samples to determine a best more rigid material.

First, a range of materials including a paperboard, plastic sheet and corrugated fiberboard were evaluated for output performance. Sample paperboard thickness was varied from approximately 0.010" to 0.100"; a high density polyethylene sheet (HDPE) was varied in thickness from approximately 0.005" to 0.100"; and a corrugated fiberboard corrugation was varied from B flute to N flute.

User ratings determined that a paperboard with a thickness less than approximately 0.080" did not have sufficient stiffness for acceptable dispensing and "ease of use." A thicker paperboard gave improved performance results but was rated unacceptable because of bulky feel. Thinner HDPE samples below 0.040" in thickness, were rated unacceptable because of insufficient stiffness. Thicker HDPE samples showed improved performance but increased cost.

Performance for corrugated fiberboard was best in the E- and F-flute range. The letter designation relates to flute size or refers to the number of flutes per lineal foot. An E-flute has 90+/−4 flutes per lineal foot and a flute thickness of 1/16 inch and an F-flute has 128+/−4 flutes per lineal foot and a flute thickness of 1/32 inch. The E-fluted and F-fluted corrugated fiberboard packets had a single handed use dispensing percentage of approximately 80% and greater. The E-flute corrugated fiberboards also received the best "ease of use" ratings.

Example 4

Another series of tests was conducted to determine a best performing packet in terms of sealant bead shape. A standard bead was defined as a deposit of sealant with a circular cross section.

First tested packets had only a top film pouch and thicker bottom material sidewall. The thicker material sidewall was folded to form a nozzle. However, the nozzles formed from the folded sidewall were flexible and formed a non-uniform bead. A bead cross section would initiate in a shape of a thin horizontal diamond. Then later in the dispensing, the bead cross section would be formed in the unacceptable shape of a thin vertical diamond. Furthermore, the top film tended to form sharper folds and creases at the nozzle, making the cross section less uniform.

In the tests of this EXAMPLE, a semi-rigid material was added to one sidewall adjacent to the packet tip end. In these EXAMPLES, when the more rigid material sidewall was folded along its longitudinal axis to squeeze the pouch, the semi-rigid material bent in a controlled manner to a substantially U-expressing shape. The U-expressing shape ensured that one half of the cross section was more uniform and round and constrained edges of the flexible sidewall to provide a uniform and round expressed bead.

Example 5

HDPE was selected as a cost-acceptable material for a top film pouch. The HDPE was found to adhere to the rigid foldable sidewall material. In expressing tests, the HDPE materials cooperated with the U-expressing shape in forming a desirable cross section bead. Optimum HDPE was determined through a series of experiments on 0.005" to 0.030" thick HDPE. A 0.015" thickness was found to have the best performance of that range of materials in forming bead cross section.

While preferred embodiments of the invention have been described, the present invention is capable of variation and modification and therefore should not be limited to the precise details of the Examples. The invention includes changes and alterations that fall within the purview of the following claims.

What is claimed is:

1. A method of forming and filling a pouch for dispensing a sealant, comprising:

determining a film material of a multilayer polymer laminate and an aluminum layer, having a determined thickness to form a single use pouch for dispensing a sealant;

forming opposing walls of the determined multilayer polymer laminate and aluminum layer;

sealing the opposing walls together to form at least one pouch of the determined material and thickness;

filling an interior section the at least one pouch through an opening in an upper portion of the at least one pouch with a flowable sealant;

forming a top sealed expressing-shaped region to close the opening in the at least one pouch; and cradling the pouch with a foldable flat that is a separate piece from the pouch and more rigid than the pouch that can be folded or rolled to compress the pouch to express the flowable sealant through the expressing shaped region.

2. The method of claim 1, wherein the more rigid flat comprises a crease that is a divide between more rigid flat sections configured to form cradling compression surfaces against the pouch.

3. The method of claim 1, comprising determining a multilayer polymer laminate and aluminum layer having a thickness between about 0.0045 and about 0.0075 inches for a material and thickness of the pouch.

4. The method of claim 1, comprising determining a multilayer polymer laminate and aluminum layer having a thickness of about 0.0060 inches for a material and thickness of the pouch.

5. The method of claim 1, wherein the foldable rigid flat comprises a paperboard more than ten mills (0.010 inch) in thickness.

6. The method of claim 1, wherein the foldable rigid flat comprises corrugated fiberboard having a thickness between about 0.045 and 0.065 inches.

7. The method of claim 1, wherein the foldable rigid flat comprises corrugated fiberboard having a thickness between 0.50 and 0.60 inches.

8. The method of claim 1, comprising forming the pouch with a semicircular-shaped tear tab to facilitate opening at the first closure end.

9. The method of claim 1, comprising filling the pouch with a flowable sealant comprising an RTV composition.

10. The method of claim 1, comprising filling the pouch with a flowable sealant comprising a polysiloxane component comprising a mixture or reaction product of (i) a polysiloxane polymer having hydrolyzable substituent groups and (ii) a polyfunctional silicon compound having two or more hydrolyzable substituent groups.

11. The method of claim 1, comprising filling the pouch with a flowable sealant comprising a polysiloxane component comprising a mixture or reaction product of (i) a polysiloxane polymer having hydrolyzable substituent groups and (ii) a polyfunctional silicon compound having two or more hydrolyzable substituent groups and includes a filler.

12. The method of claim 1, comprising filling the pouch with a flowable sealant comprising a polysiloxane component comprising a mixture or reaction product of (i) a polysiloxane polymer having hydrolyzable substituent groups and (ii) a polyfunctional silicon compound having two or more hydrolyzable substituent groups and includes a filler and a condensation cure catalyst.

13. The method of claim 1, wherein the foldable flat comprises a combination of paperboards.

14. The method of claim 1, wherein the foldable flat comprises a combination of two flat pieces of paper and one inner fluted corrugated medium.

15. The method of claim 1, wherein the foldable flat comprises of a material selected from the group consisting of stiff paper, cardboard, pasteboard and paperboard.

16. The method of claim 1, wherein the foldable flat comprises of corrugated paperboard and high density polyethylene.

17. The method of claim 1, wherein the foldable flat comprises of a thermoplastic.

18. The method of claim 1, wherein the foldable flat comprises of ABS (acrylonitrile-butadiene-styrene).

19. The method of claim 1, wherein the foldable flat comprises of a paperboard that is about 10 mils or 0.010 inches in thickness or greater.

20. The method of claim 1, wherein the foldable flat comprises a linerboard and a medium.

21. The method of claim 1, wherein the foldable flat comprises a corrugated board medium glued to one linerboard.

22. The method of claim 1, wherein the foldable flat comprises multiple corrugated board mediums between multiple sheets of linerboard.

23. The method of claim 1, comprising cradling the pouch with a foldable flat comprising corrugated fiberboard.

* * * * *